US007936320B2

(12) United States Patent
Chung et al.

(10) Patent No.: US 7,936,320 B2
(45) Date of Patent: May 3, 2011

(54) DRIVING METHOD OF PLASMA DISPLAY PANEL AND DISPLAY DEVICE THEREOF

(75) Inventors: Woo-Joon Chung, Suwon-si (KR); Jin-Sung Kim, Suwon-si (KR); Seung-Hun Chae, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 793 days.

(21) Appl. No.: 11/966,949

(22) Filed: Dec. 28, 2007

(65) Prior Publication Data

US 2008/0158103 A1 Jul. 3, 2008

Related U.S. Application Data

(63) Continuation of application No. 10/996,723, filed on Nov. 22, 2004, now Pat. No. 7,342,557.

(30) Foreign Application Priority Data

Nov. 26, 2003 (KR) ..... 10-2003-0084472

(51) Int. Cl.
*G09G 3/28* (2006.01)

(52) U.S. Cl. ..... 345/60; 315/169.1

(58) Field of Classification Search ..... 345/40, 345/41, 60–63, 67; 315/169.1, 169.3
See application file for complete search history.

(56) References Cited

U.S. PATENT DOCUMENTS 6,667,579 B2 * 12/2003 Kanazawa et al. ..... 315/169.3
6,809,708 B2 * 10/2004 Kanazawa et al. ..... 345/68
6,956,331 B2 * 10/2005 Lee et al. ..... 315/169.1
6,963,320 B2 * 11/2005 Kanazawa ..... 345/60
7,049,755 B2 * 5/2006 Kosaka ..... 315/169.4
7,050,022 B2 * 5/2006 Kigo et al. ..... 345/66
7,053,870 B2 * 5/2006 Shoji et al. ..... 345/60

(Continued)

FOREIGN PATENT DOCUMENTS

CN 1397923 2/2003

(Continued)

OTHER PUBLICATIONS

Korean Patent Abstracts for Publication No. 1020020061500; Date of publication of application Jul. 24, 2002, in the name of Seong Ho Kang.

*Primary Examiner* — Nitin Patel
(74) *Attorney, Agent, or Firm* — Christie, Parker & Hale, LLP

(57) ABSTRACT

A plasma display device includes a plasma display panel (PDP) and a driving method for driving the PDP. The PDP includes discharge cells that are formed by scan electrodes, sustain electrodes, and address electrodes. The driving method divides a frame of the plasma display panel into a plurality of subfields having respective weights in which gray scales are represented by a combination of the subfields. The plurality of subfields are divided into a first group and a second group. In an address period of a subfield of the first having a lowest weight subfield of the plurality of subfields, the method applies a scan voltage and an address voltage respectively to the scan electrode and the address electrode of a discharge cell to be selected from the discharge cells. The scan voltage is applied to the scan electrode and the scan electrode is floated.

21 Claims, 9 Drawing Sheets

U.S. PATENT DOCUMENTS

| | | | | |
|---|---|---|---|---|
| 7,436,375 | B2 * | 10/2008 | Hirakawa et al. | 345/60 |
| 2002/0053882 | A1 * | 5/2002 | Kanazawa et al. | 315/169.3 |
| 2003/0057858 | A1 | 3/2003 | Lee et al. | |
| 2003/0107532 | A1 | 6/2003 | Choi | |
| 2003/0189534 | A1 * | 10/2003 | Myoung et al. | 345/67 |
| 2004/0125051 | A1 * | 7/2004 | Hirakawa et al. | 345/63 |
| 2004/0251830 | A1 * | 12/2004 | Nagao et al. | 313/582 |
| 2005/0030261 | A1 * | 2/2005 | Chae et al. | 345/60 |
| 2005/0116885 | A1 * | 6/2005 | Sasaki et al. | 345/60 |

FOREIGN PATENT DOCUMENTS

| | | | |
|---|---|---|---|
| CN | 1410960 | | 4/2003 |
| EP | 1 324 302 | A2 | 7/2003 |
| KR | 2002-0061500 | | 7/2002 |

* cited by examiner

DRIVING METHOD OF PLASMA DISPLAY PANEL AND DISPLAY DEVICE THEREOF

CROSS REFERENCE TO RELATED APPLICATION

This application is a continuation of U.S. patent application Ser. No. 10/996,723, filed Nov. 22, 2004, which claims priority to and the benefit of Korea Patent Application No. 10-2003-0084472 filed on Nov. 26, 2003 in the Korean Intellectual Property Office, the entire content of which is incorporated herein by reference.

BACKGROUND OF THE INVENTION (a) Field of the Invention

The present invention relates to a plasma display panel. More specifically, the present invention relates to a display device and driving method for the purpose of maximizing a representation performance of low gray scales.

(b) Description of the Related Art

Various flat displays such as a liquid crystal display (LCD), a field emission display (FED), and a plasma display panel (PDP) have been developed. The plasma display panel has higher resolution, a higher rate of emission efficiency, and an wider view angle in comparison with other flat panel displays. Accordingly, the plasma display panel has come into the spotlight as a display that can be substituted for the conventional cathode ray tube (CRT), especially in the large-sized displays of greater than forty inches.

The PDP is a flat panel display for showing characters or images using plasma generated by gas discharge. The PDP can include hundreds of thousands to millions of pixels in a matrix format. With reference to FIG. 1 and FIG. 2, a configuration of the plasma display panel will be described.

FIG. 1 shows a partial perspective view of a PDP. As shown, the PDP includes two glass substrates 1, 6 facing each other, and scan electrodes 4 and sustain electrodes 5 are formed in pairs parallel on (or under) a first glass substrate 1 and covered with a dielectric layer 2 and a protection film 3. Address electrodes 8 are established on a second glass substrate 6, and address electrodes 8 are covered with insulator layer 7. Barrier ribs 9 are formed in parallel with address electrodes 8 on insulator layer 7 and between address electrodes 8. Phosphors 10 are formed on the surface of the insulator layer 7 and on both sides of the barrier ribs 9. First and second glass substrates 1, 6 are provided to face each other with a discharge space 11 between the glass substrates 1, 6 so that scan electrodes 4 and sustain electrodes 5 may respectively cross (or cross over) address electrodes 8. Discharge space 11 between an address electrode of address electrodes 8 and a crossing part of a pair of scan electrodes 4 and sustain electrodes 5 forms discharge cell 12, which is schematically indicated.

FIG. 2 shows an electrode arrangement of a PDP. As shown, the electrodes of the PDP have an n×m matrix format. Address electrodes A1 to Am are arranged in a column direction, and n scan electrodes Y1 to Yn and n sustain electrodes X1 to Xn are alternately arranged in a row direction. In the context of the following discussion, the scan electrodes can also be referred to as "Y electrodes" and the sustain electrodes can also be referred to as "X electrodes." In addition, discharge cell 12 of FIG. 2 substantially corresponds to discharge cell 12 of FIG. 1

A PDP divides a frame into a plurality of the subfields in order to be driven, and represents gray scales by the combination of respective subfields. Conventionally, each subfield comprises a reset period, an address period, and a sustain period. In the reset period, wall charges of a previous sustain-discharge are erased, and new wall charges are generated so as to stably perform the next address discharge. In the address period, cells that are turned on and the same that are turned off on the panel are selected, and the wall charges are accumulated to the cells that are turned on (i.e., addressed cells). In the sustain period, a discharge for substantially displaying images on the addressed cells is performed.

FIG. 3 shows a conventional PDP driving waveform diagram of certain subfields and emitted light from the subfields. The performance of the low gray scale representation performance is increased when a minimum discharge is generated in the subfield which represents minimum gray scales (units of light) in the PDP. As shown, light of the subfield with a weight of 1 for representing the minimum gray scales in the plasma display panel is given as a sum of light generated in the reset period, light generated in the selected cell in the address period, and light generated when one sustain-discharge is generated during the sustain discharging of the sustain period.

In particular, the reset period in the subfield with the weight of 1 includes a ramp rising period and a ramp falling period. A reset-discharge in the reset period is weak, and therefore light generated by the reset-discharge can be ignored. As such, the subfield with the weight of 1 for representing a gray scale 1 can be represented by only light generated in the address period (address light) and light generated in the sustain period (sustain light).

To improve efficiency of a PDP, a concentration of Xe of the discharge gas is increased, and therefore emission efficiency and brightness is increased However, representation performance of low gray scales becomes a problem because a size of the unit of light generated by the sustain-discharging is increased when concentrations of high pressure gas and the Xe are increased in the PDP when the PDP is driven. Accordingly, there has been a limit in representing low gray scales in driving waveforms of a conventional PDP.

In particular for example, a considerable amount of light is emitted by the time of the sustain-discharge (sustain light) due to the address-discharge (address light) generated in the subfield with a weight of 1. As such, there is a need to reduce the address light itself for the purpose of effectively realizing low gray scales on a PDP because the emission of the address-discharge itself generates considerable brightness even if the emission of the one sustain-discharge pulse in the time of the sustain-discharge or sustain period is reduced.

SUMMARY OF THE INVENTION

It is an aspect of the present invention to provide a driving method and a plasma display device that reduces a minimum unit of light in a subfield which represents a minimum gray scale and/or that reduces an address discharging for the purpose of maximizing representation performance of low gray scales.

One exemplary embodiment of the present invention provides a method for driving a plasma display panel in which discharge cells are formed by scan electrodes, sustain electrodes, and address electrodes and in which a frame of the plasma display panel is divided into a plurality of subfields having respective weights. A combination of the subfields represents gray scales, and the plurality of subfields, including a lowest weight subfield, are divided into a first group and a second group. In the method, a scan voltage and an address voltage are respectively applied to the scan electrode and the address electrode of a discharge cell selected from the discharge cells, the scan voltage is applied to the scan electrode, and the scan electrode is floated in an address period of a first subfield of the first group having the lowest weight subfield. At this time, the scan voltage at the first subfield of the first group may corresponds to the scan voltage at a second subfield of the second group, and the scan voltage at the first subfield of the first group may be greater than the scan voltage at the second subfield of the second group.

In the reset period of the first subfield of the first group, a voltage waveform for gradually reducing the voltage at the scan electrode from a first voltage to a second voltage may be applied to the scan electrode. At this time, the second voltage may correspond to a final voltage applied in a reset period of the second subfield of the second group.

In the reset period of the first subfield of the first group, a voltage waveform for gradually reducing the voltage at the scan electrode from a first voltage to a second voltage may be applied to the scan electrode. At this time, the third voltage may be less than the final voltage applied in the reset period of the second subfield of the second group.

One exemplary embodiment of the present invention provides a method for driving a plasma display panel in which discharge cells are formed by scan electrodes, sustain electrodes, and address electrodes and in which a frame of the plasma display panel is divided into a plurality of subfields having weights. A combination of the subfields represents gray scales, and the plurality of subfields, including a lowest weight subfield, are divided into a first group and a second group. In the method, in a first subfield of the first group having the lowest weight subfield, a voltage waveform falling from a first voltage to a final voltage is applied to the scan electrode of one of the discharge cells in a reset period; and a scan voltage and an address voltage are respectively applied to the scan electrode and the address electrode of the one discharge cell in an address period. At this time, a difference between a final voltage at the first subfield of the first group and the scan voltage is greater than a difference between a final voltage and a scan voltage of a second subfield of the second group.

The final voltage of the first subfield of the first group may be less than the final voltage at the second subfield of the second group, and the scan voltage at the first subfield of the first group may be greater than the scan voltage at the second subfield of the second group.

In one exemplary embodiment of the present invention, a plasma display device is provided. The plasma display device includes a plasma display panel in which discharge cells are formed between scan electrodes, sustain electrodes, and address electrodes, and a driving circuit in which a frame is divided into a plurality of subfields respectively, each subfield having a respective weight, and a driving voltage is applied to one of the scan electrodes, one of the sustain electrodes, and one of the address electrodes for each subfield in a reset period, an address period, and a sustain period. The plurality of subfields including a lowest weight subfield are divided into a first group and a second group, and the first group has the lowest weight subfield. In the address period, the driving circuit allows the discharging in a first subfield of the first group to be less than in a second subfield of the second group.

The driving circuit may apply a sustain-discharging pulse having a second voltage to the scan electrode for the sustain period.

Also, a rising voltage waveform applied at the scan electrode may be gradually increased to a third voltage from the second voltage applied to the scan electrode in one of the subfields of the first group, and a part of the rising voltage waveform applied to the scan electrode is also provided in the reset period of a subfield following the one subfield.

A falling voltage waveform applied at the scan electrode may be gradually reduced to a fourth voltage from the second voltage applied to the scan electrode in one of the subfields of the first group, and a part of the falling voltage waveform applied to the scan electrode is also provided in the reset period of a subfield following the one subfield.

BRIEF DESCRIPTION OF THE DRAWINGS

The accompanying drawings, together with the specification, illustrate exemplary embodiments of the present invention, and, together with the description, serve to explain the principles of the invention.

DETAILED DESCRIPTION

In the following detailed description, only certain exemplary embodiments of the present invention are shown and described, simply by way of illustration. As those skilled in the art would realize, the described exemplary embodiments may be modified in various different ways, all without departing from the spirit or scope of the present invention. Accordingly, the drawings and description are to be regarded as illustrative in nature, and not restrictive.

Figure 1:
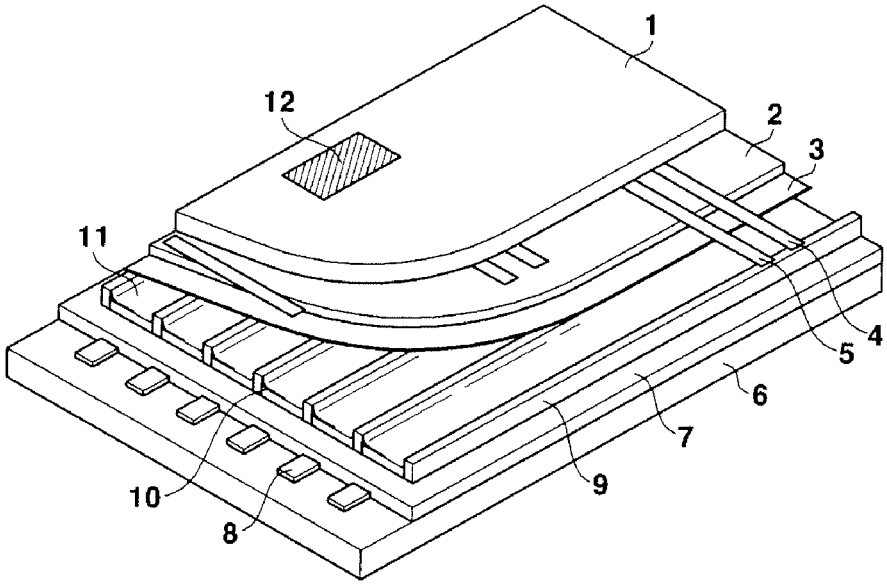
FIG.1 (Prior Art)
FIG. 1 shows a partial perspective view of an alternating current (AC) plasma display panel (PDP).
Figure 2:
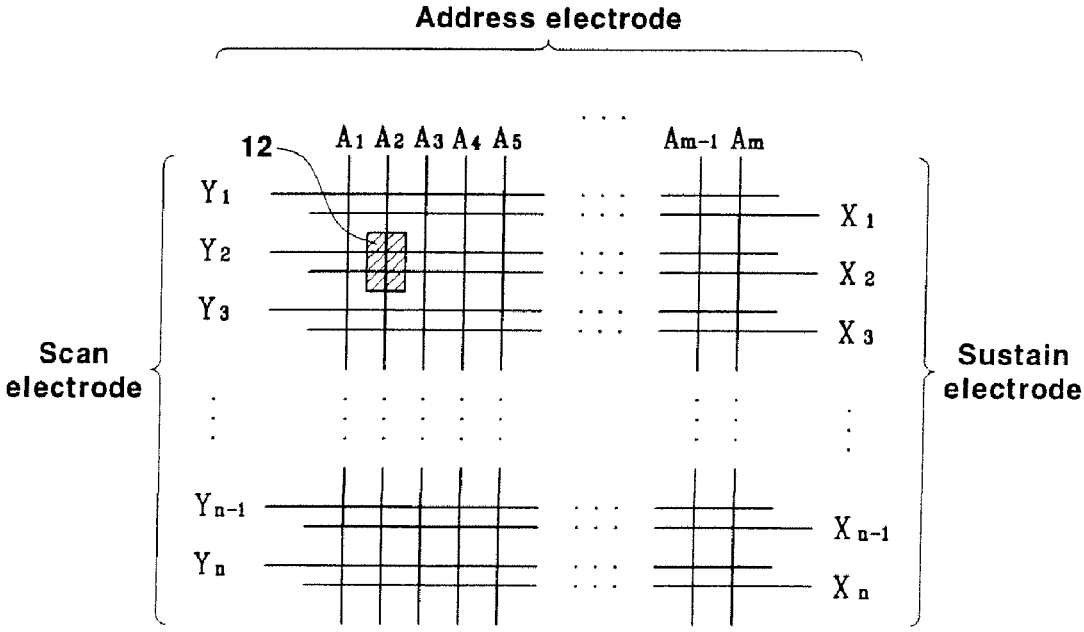
FIG.2 (Prior Art)
FIG. 2 shows a diagram for representing an electrode arrangement of a plasma display panel.
Figure 3:
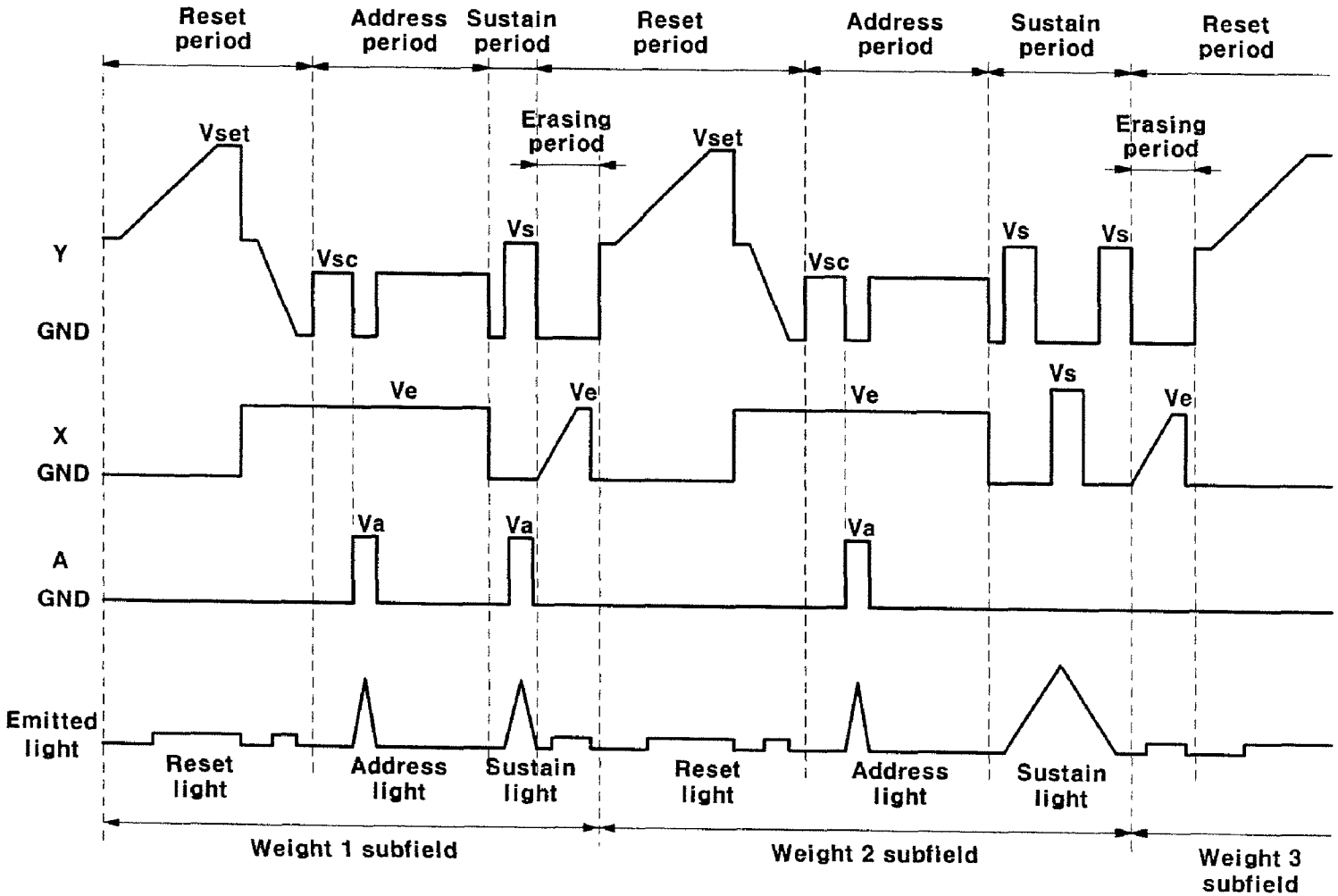
FIG. 3 shows a diagram for representing conventional plasma display panel driving waveforms of certain subfields, and emitted light from the subfields.
Figure 4:
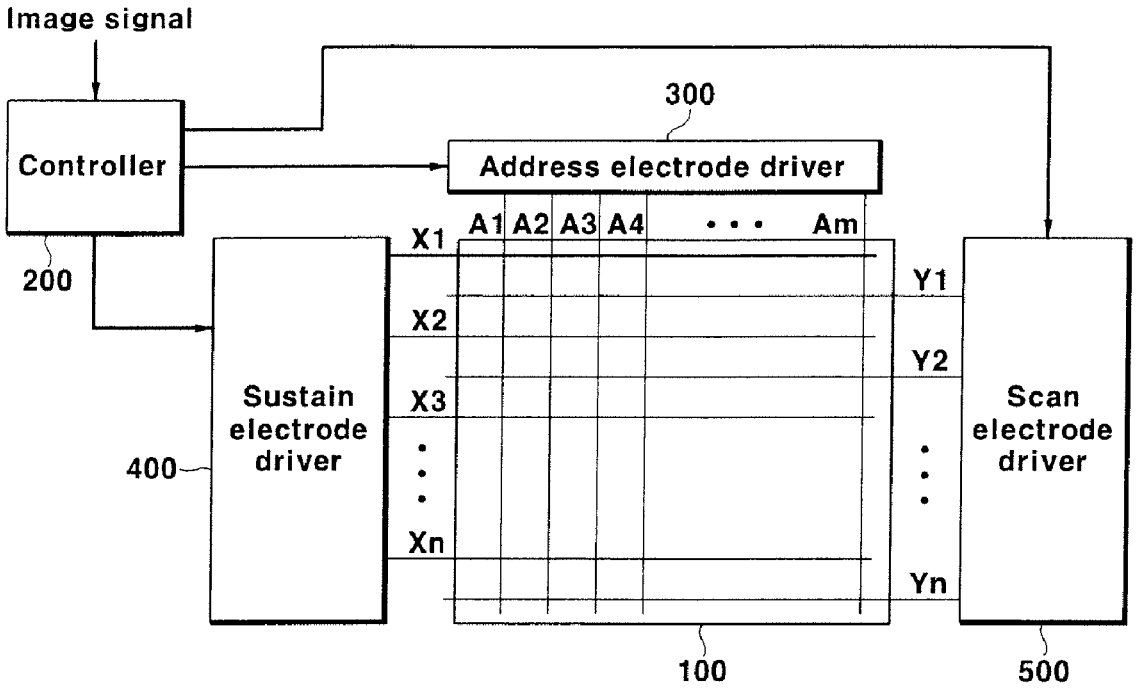
FIG. 4 shows a diagram for representing a plasma display panel according to certain embodiments of the present invention.

FIG. 4 shows a plasma display panel according to an exemplary embodiment of the present invention. The plasma display panel includes plasma panel 100, controller 200, address electrode driver 300, sustain electrode driver 400, and scan electrode driver 500.

Plasma panel 100 includes a plurality of address electrodes A1 to Am arranged in a column direction, and a plurality of sustain electrodes X1 to Xn and scan electrodes Y1 to Yn arranged in a row direction. Controller 200 externally receives an image signal, and outputs an address electrode driving control signal, a sustain electrode or X electrode driving control signal, and a scan electrode or Y electrode driving control signal. Address electrode driver 300 receives the address electrode driving control signal from controller 200, and applies a display data signal for selecting a discharge cell to be displayed to a respective address electrode. Sustain electrode driver 400 receives the sustain electrode driving control signal from controller 200, and applies a driving voltage to respective sustain electrode X. Scan electrode driver 500 receives the scan electrode driving control signal from the controller 200, and applies a driving voltage to respective scan electrode Y. Data are accordingly displayed on plasma panel 100.

Generation of a scan electrode driving signal, a sustain electrode driving signal, and an address electrode driving signal by controller 200 will be described with reference to FIG. 5, FIG. 6 and FIG. 7. A driving method for maximizing representation performance of low gray scales of the plasma display panel will be described in first, second, third, fourth, fifth and sixth exemplary embodiments of the present invention.

As discussed above, low gray scales of a plasma display panel (PDP) are represented, for example, by a sum of reset light, address light, and sustain light in a subfield with a weight of 1. However, the reset light by reset discharging in the reset period is weak enough that it can be ignored, and therefore the low gray scales can be substantially represented by the address light and the sustain light in the subfield with the weight of 1.

Figure 5:
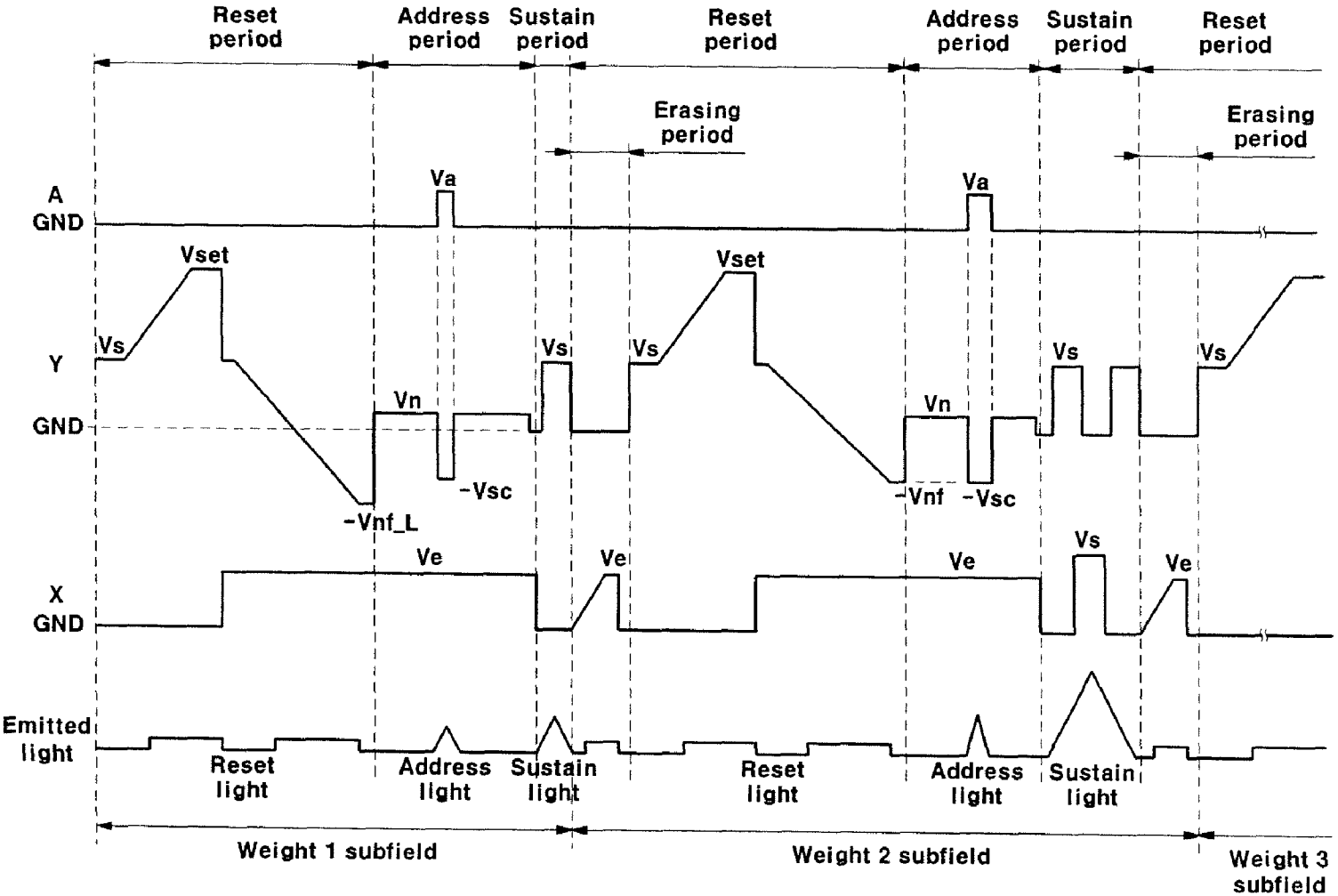
FIG. 5 shows a diagram for representing plasma display panel driving waveforms and emitted light from each subfield according to a first exemplary embodiment of the present invention.

FIG. 5 shows a diagram for representing plasma display panel driving waveforms and an emitted amount of light generated from each subfield according to the first exemplary embodiment of the present invention. As shown, a subfield with a weight of 1 for representing low gray scales in a driving waveform according to the first exemplary embodiment of the present invention includes a reset period, an address period, and a sustain period. A plasma display panel (e.g., the PDP of FIG. 4) is coupled to scan/sustain driving circuits (not shown in the diagram) which apply a driving voltage to scan electrode Y and sustain electrode X in each period, and an address driving circuit (not shown in the diagram) which applies a driving voltage to address electrode A. The driving circuits and the plasma display panel are coupled to each other to thus form a plasma display device.

The reset period of the subfield with the weight of 1 includes a ramp rising period and a ramp falling period. In particular, a gradually rising ramp voltage waveform from a voltage of Vs to a voltage of Vset is applied to scan electrode Y in the ramp rising period. A reset discharge is generated at address electrode A and sustain electrode X from scan electrode Y when the ramp voltage waveform rises. Because of the reset discharge, wall charges are formed on scan electrode Y, sustain electrode X, and address electrode A.

The wall charges can be referred to as charges formed on a wall of a discharge cell neighboring each electrode and accumulated by the electrodes. Although the wall charges are not actually in contact with the electrodes, in the context of the following discussion, the wall charges will be described as the wall charges being "generated", "formed", or "accumulated" thereon. In addition, a wall voltage can be referred to as a potential difference formed on the wall of the discharge cells by the wall charges.

A falling ramp voltage waveform from the voltage of Vs to a voltage of −Vnf_L (or negative Vnf_L) is applied to scan electrode Y while sustain electrode X is maintained at the voltage of Ve in the ramp falling period. The voltage of −Vnf_L is less than a final voltage of −Vnf applied in the ramp falling period of a subfield with a weight of 2 (another subfield).

In particular, during the ramp falling period, a weak discharge between scan electrode Y and address electrode A is generated and the discharging between the scan electrode Y and the address electrode A is controlled. The wall charges formed by the reset discharge in the ramp rising period are eliminated by the weak discharge because new wall charges are formed on scan electrode Y, sustain electrode X, and address electrode A. At this time, more wall charges are eliminated in this subfield than another subfield (e.g., the subfield with the weight of 2) because slopes of voltages applied in the ramp rising periods of respective subfields are the same, and the final voltage of −Vnf_L of the ramp falling period in the reset period of this subfield with the weight of 1 is less than the voltage of −Vnf of the ramp falling period in the reset period of the another subfield.

While scan electrode Y and sustain electrode X are respectively maintained at a voltage of Vn and a voltage of Ve in the address period, a scan pulse and an address pulse are then applied to scan electrode Y and address electrode A for the purpose of selecting a discharge cell to be displayed.

In more detail, a positive voltage of Va is applied to address electrode A on a to be displayed discharge cell of a first row when a negative voltage of −Vsc is applied to scan electrode Y of the first row. The voltage of −Vsc and the final voltage of −Vnf in the reset period of the subfield with the weight of 2 (the another subfield) are established to have the same level in FIG. 5.

An address discharge is generated between address electrode A and scan electrode Y, and between sustain electrode X and scan electrode Y in the discharge cell formed by address electrode A to which the voltage of Va is applied and scan electrode Y to which the voltage of −Vsc is applied. That is, in the discharge cell of the first row in which the difference between the voltage applied to scan electrode Y and the voltage applied to address electrode A is a voltage of (Va+Vsc).

Next, the voltage of Va can then be applied to address electrode A on a to be displayed discharge cell of a second row when the voltage of −Vsc is applied to scan electrode Y of the second row. The address discharging is generated between address electrode A and scan electrode Y, and between sustain electrode X and scan electrode Y in the discharge cell formed by address electrode A to which voltage of Va is applied and scan electrode Y to which the voltage of −Vsc is applied.

The voltage of Va can then be applied to address electrode A provided on another to be displayed discharge cell of another row to generate an address discharge, and form the wall charges when the voltage of −Vsc is applied to scan electrodes of the another row in sequence in the like manner of the above description. Hence, a sequence of address light can be formed by the address discharges. As such, although the addressing operation is only shown to have been generated once in the address period of the subfield with the weight of 1 in FIG. 5, the first exemplary embodiment is not restricted to this one generation.

In addition, the address discharging is generated by the difference between the voltage of Va applied to address electrode A and the voltage of −Vsc applied to scan electrode Y, and wall voltage caused by the wall charges formed on address electrode A and scan electrode Y. However, in the first exemplary embodiment and the subfield with the weight of 1, the wall voltage has decreased because a large amount of wall charges formed on the respective electrodes had been eliminated in the earlier ramp falling period of the reset period. That is, a voltage for discharging is given as a sum of externally applied voltages and the wall voltages of the internal wall charges, and the voltage for discharging is decreased because the wall voltage in the subfield with the weight of 1 is less than that in the other subfields (e.g., the subfield with the weight of 2). Accordingly, weaker address discharging is generated as compared to that of the other subfields. The performance of the low gray scales representation is increased because the light generated by the address discharging is weakened by the lower wall voltage. Also, the performance of the low gray scale representation is effectively increased because the address discharging is controlled according to the erased amount of wall charges in the reset period.

In the sustain period, a reference voltage of 0V (or GND) is applied to sustain electrode X when the voltage of Vs is applied to scan electrode Y. The voltage between scan electrode Y and sustain electrode X is a sum of the voltage of Vs and the wall voltage generated by the wall charges formed on scan electrode Y and sustain electrode X in the address period. This cumulative voltage (e.g., Vs and the wall voltage) exceeds the discharge firing voltage. Therefore a sustain discharge is generated once between scan electrode Y and sustain electrode X. However, this generated sustain discharge is weakened because less wall charges are generated on each electrode by the weaker address discharging. Accordingly, the sustain light caused by the sustain discharging is decreased in the subfield with the weight of 1 as compared with the other subfields.

That is, according to the first exemplary embodiment of the present invention, the performance of the low gray scale representation is increased because the final voltage (e.g., −Vnf_L) applied to scan electrode Y for the ramp falling period in the reset period of the subfield with the weight of 1 for representing the low gray scales is less than the final voltage (e.g., −Vnf) applied for the ramp falling period of the other subfields. As such, the wall charges of scan electrode Y and address electrode A have been effectively decreased, and the address light and the sustain light are reduced.

In more detail, the subfield with the weight of 2 includes a reset period, an address period, and the sustain period. The reset period includes an erasing period, and a ramp rising period and a ramp falling period.

In the erasing period of the reset period, scan electrode Y is maintained at the reference voltage of 0V (GND), and a gradually rising waveform to the voltage of Ve is applied to sustain electrode X while wall charges are formed on scan electrode Y and sustain electrode X in the sustain period of the subfield with the weight of 1. As such, the sustain discharging is stopped during the erasing period because the wall charges of the discharge cell by the sustain discharging are reduced.

In the address period, while scan electrode Y and sustain electrode X are respectively maintained at the voltage of Vn and the voltage of Ve, the scan pulse (with the voltage of −Vsc) and the address pulse (with the voltage of Va) are applied to scan electrode Y and address electrode A in order to select the discharge cell to be displayed. At this time, the width of the scan pulse is wider than that of the corresponding pulse of the subfield with the weight of 1. In the sustain period, more sustain discharging pulses for the sustain discharging are applied than those of the subfield with the weight of 1.

Afterward, another subfield (e.g., weight of 3) that is started from a new reset period can be continued in a like manner of the subfield with the weight of 2 described above.

In general and in view of the foregoing, the wall voltages of the internal wall charges of the first exemplary embodiment of the present invention are reduced, and the address light and the sustain light are reduced in the reset period of the subfield with the weight of 1.

Figure 6:
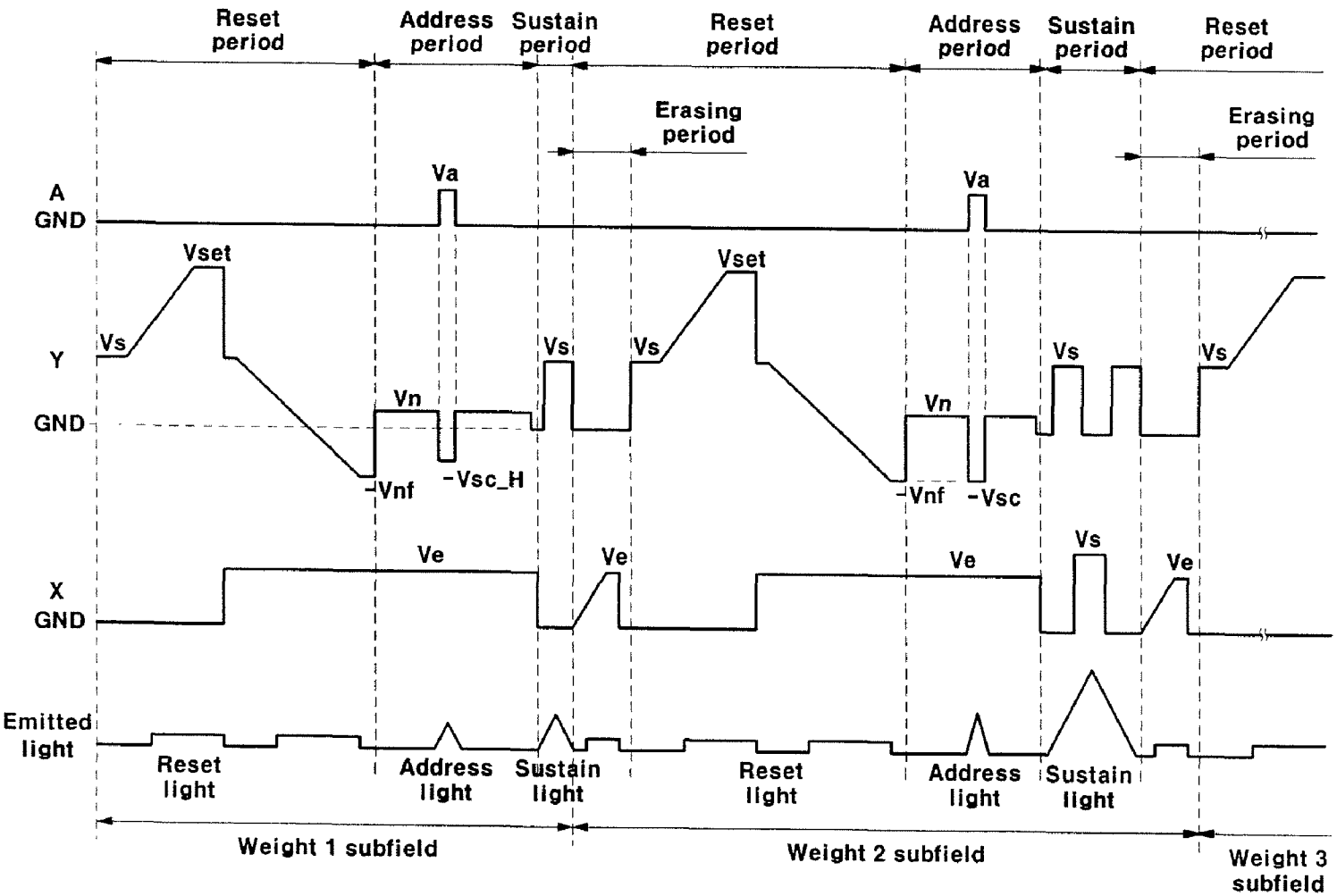
FIG. 6 shows a diagram for representing plasma display panel driving waveforms and emitted light from each subfield according to a second exemplary embodiment of the present invention.

FIG. 6 shows a diagram for representing plasma display panel driving waveforms and emitted light from each subfield according to the second exemplary embodiment of the present invention for reducing an amount of an externally applied voltage. As shown, a ramp voltage falling from a voltage of Vs to a voltage of −Vnf is applied to scan electrode Y while sustain electrode X is maintained at a voltage of Ve in the ramp falling period in the reset period of a subfield with a weight of 1.

In the address period, while scan electrodes are maintained at a voltage of Vn (not shown), one of the scan electrodes Y is selected and a negative voltage of −Vsc_H is applied to selected scan electrode Y in sequence. An address voltage of Va is applied to address electrode A forming a discharge cell to be selected from a discharge cells formed by scan electrode Y to which the voltage of −Vsc_H is applied. The level of the voltage of −Vsc_H is lower than the level of the voltage of −Vsc, and their signs (i.e., negative signs or polarities) are the same. The voltages of −Vsc_H and Va (or Va+Vsc_H) establishes the voltage difference between address electrode A and scan electrode Y of the selected discharge cell in the address period and this voltage difference is greater than a discharge firing voltage. The voltage of −Vsc is established to be the same level as the voltage of −Vnf in the reset period in FIG. 6. The externally applied voltage is reduced because the difference between the voltages applied to scan electrode Y and address electrode A in the subfield with the weight of 1 is a voltage of Vsc_H+Va (which is lower than Vsc+Va). Accordingly, a scan discharging, which is weaker than the other subfields, is generated because the voltage for discharging is reduced. The address light is decreased because intensity of the discharging is in proportion to the emitted light. In addition, the sustain light derived by the sustain discharging is reduced when the sustain discharging is generated by the weaker address discharging due to a less wall charges generation effect as described above for the first exemplary embodiment. As such, the performance of the low gray scales representation is increased in the second exemplary embodiment by reducing the externally applied voltage. However, the external voltage can be reduced in different manners, which will be described with reference to FIG. 7 and FIG. 8.

Figure 7:
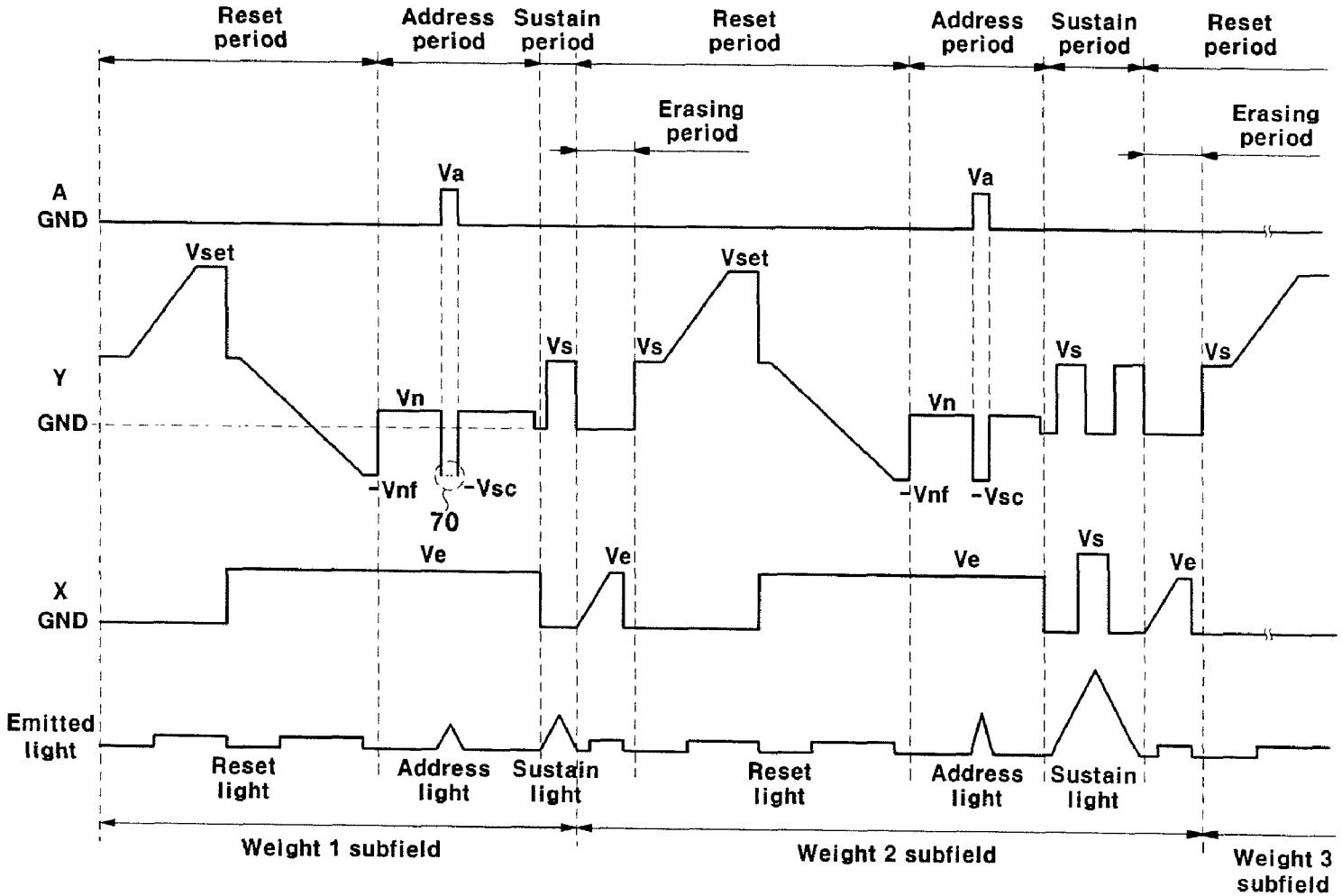
FIG. 7 shows a diagram for representing plasma display panel driving waveforms and emitted light from each subfield according to a third exemplary embodiment of the present invention.

FIG. 7 shows a diagram for representing plasma display panel driving waveforms and emitted light from each subfield according to the third exemplary embodiment of the present invention. As shown, while scan electrodes are maintained at voltage of Vn in the address period (not shown) of a subfield with a weight of 1, a negative voltage of −Vsc from an external power supply (not shown) is applied to one of the scan electrodes Y and the external power supply is then disconnected to leave scan electrode Y in a floating state as schematically indicated by 70 (i.e., scan electrode Y is now floated). An address voltage of Va is correspondingly applied to address electrode A provided on a discharge cell to be selected from among discharge cells formed by scan electrode Y to which the voltage of −Vsc is applied. As described, when the voltage of Va is applied to address electrode A, the address discharging is generated between address electrode A and scan electrode Y, and between sustain electrode X and scan electrode Y in the discharge cell formed by address electrode A to which the voltage of Va is applied and scan electrode Y to which voltage of −Vsc is applied. When the wall charges are accumulated and when the external charge supply is interrupted to float scan electrode Y, the internal voltage of the discharge space is rapidly reduced. As such, when the voltage of Va is applied to address electrode A, discharging is performed, and address electrode A is then also floated in the address period of the subfield with the weight of 1. However, since the voltage initially at (−Vsc) of floated scan electrode Y is gradually increased when the internal voltage of the discharge space is reduced, the discharging is weaker than that of the address discharging of the other subfields generated because the internal discharging is eliminated when the internal voltage of the discharge space is rapidly reduced. Accordingly, the address light is reduced.

Figure 8:
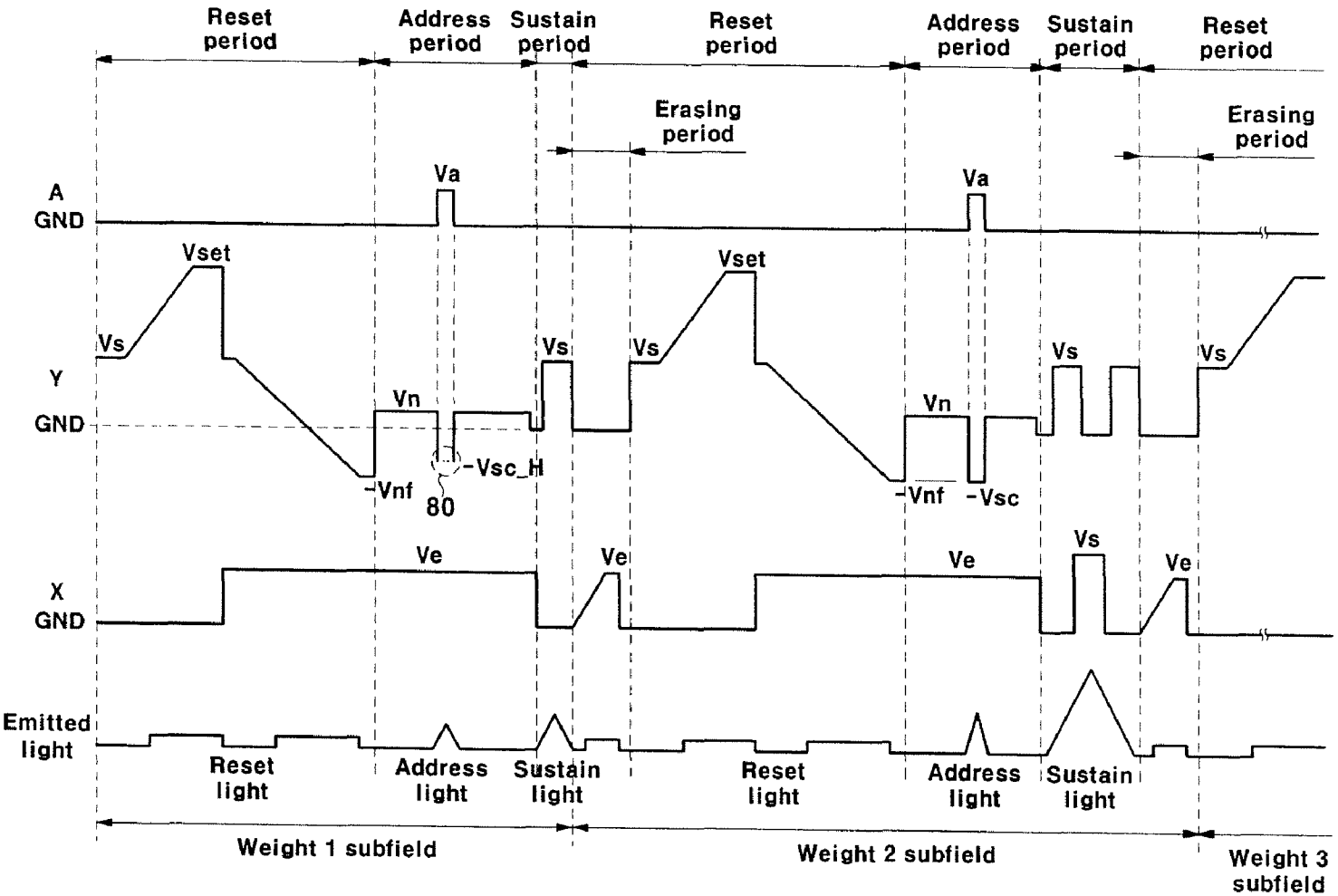
FIG. 8 shows a diagram for representing plasma display panel driving waveforms and emitted light from each subfield according to a fourth exemplary embodiment of the present invention.

FIG. 8 shows a diagram for representing plasma display panel driving waveforms and emitted light from each subfield according to the fourth exemplary embodiment of the present invention. As shown, scan electrode Y is floated after a negative voltage of −Vsc_H is applied to scan electrode Y in sequence as schematically indicated by 80 while the other scan electrodes are maintained at a reference voltage 0V (not shown). An address voltage Va is applied to address electrode A provided on the discharge cell to be selected from the discharge cells formed by scan electrode Y to which voltage of −Vsc_H is applied and then is interrupted to float scan electrode Y.

As described, the voltage for discharging is reduced because the externally applied voltage is reduced and the wall voltage of the internal wall charges is reduced. As such, the address discharging that is generated is weaker than the other subfields.

In the first and the fourth exemplary embodiments, the sustain discharging pulse is applied in the sustain period of the subfield with the weight of 1, and the erasing period is provided in order to eliminate the wall charges of the cell formed in the sustain period of the subfield with the weight of 1, however, the erase period may be eliminated.

Figure 9:
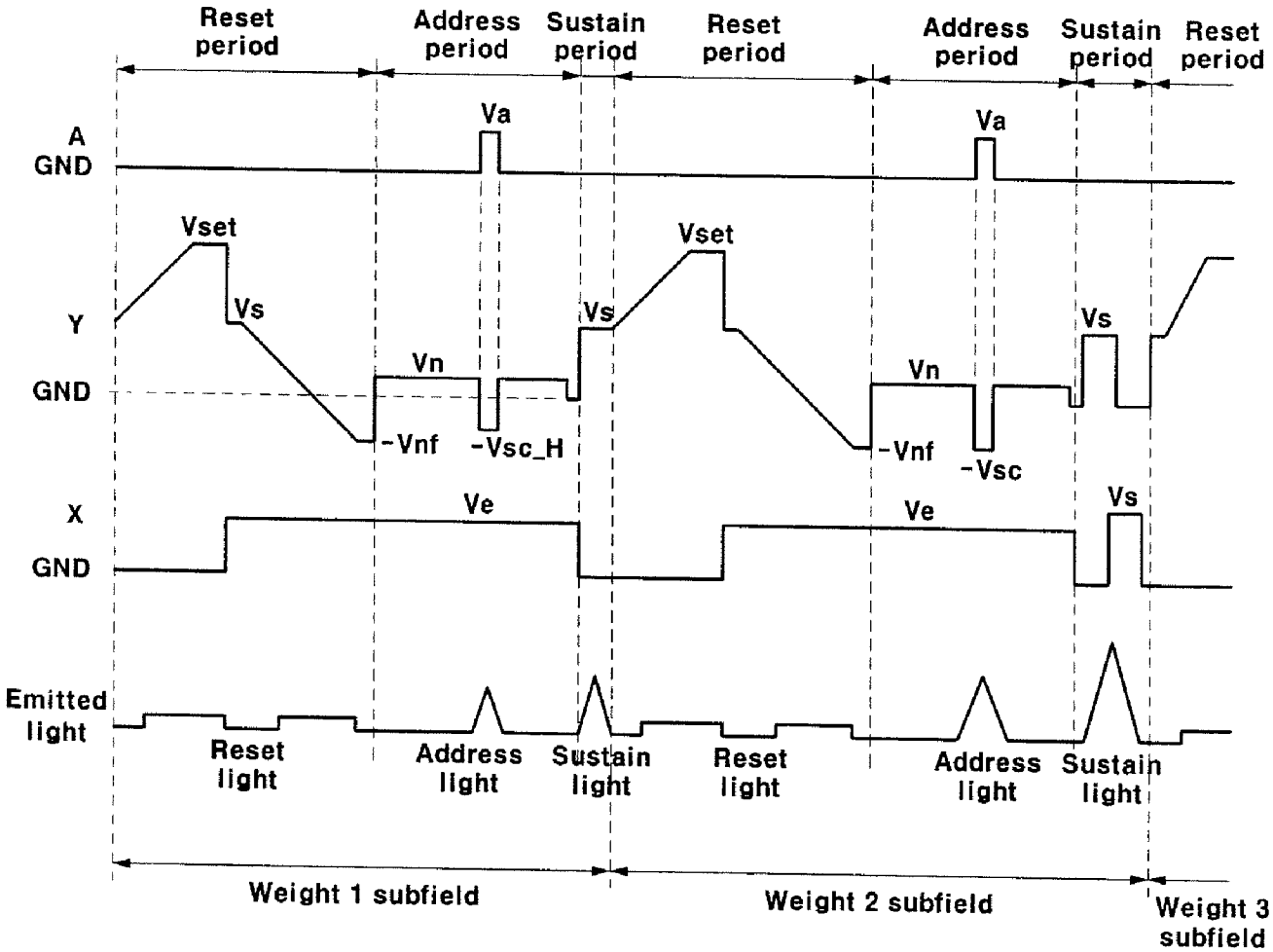
FIG. 9 shows a diagram for representing plasma display panel driving waveforms and emitted light from each subfield according to a fifth exemplary embodiment of the present invention.

In particular, FIG. 9 shows a diagram for representing plasma display panel driving waveforms and emitted light from each subfield according to the fifth exemplary embodiment of the present invention. The reset period includes a ramp rising period and a ramp falling period. As shown, the sustain discharging pulse in the sustain period of a subfield with a weight of 1 is represented by combining with an early period in the reset period of a subfield with a weight of 2 in which a voltage of Vs is applied to scan electrode Y because the voltage of Vs applied to scan electrode Y in the sustain period of the subfield with the weight of 1 corresponds to the voltage of Vs applied to scan electrode Y in the early period in the reset period of the subfield with the weight of 2.

In the reset period of the subfield after the subfield with the weight of 1 and while the voltage of Vs is applied to scan electrode Y of the subfield prior to the reset period, the voltage of scan electrode Y is increased to the voltage of Vset. Accordingly, while (−) wall charges and (+) wall charges are respectively formed on the scan electrode Y and the sustain electrode X by the voltage of Vs applied to scan electrode Y and reference voltage 0V applied to sustain electrode X in the sustain period in the subfield with the weight of 1, new (−) wall charges and the (+) wall charges are formed respectively on scan electrode Y and sustain electrode X by the ramp rising waveform.

Figure 10:
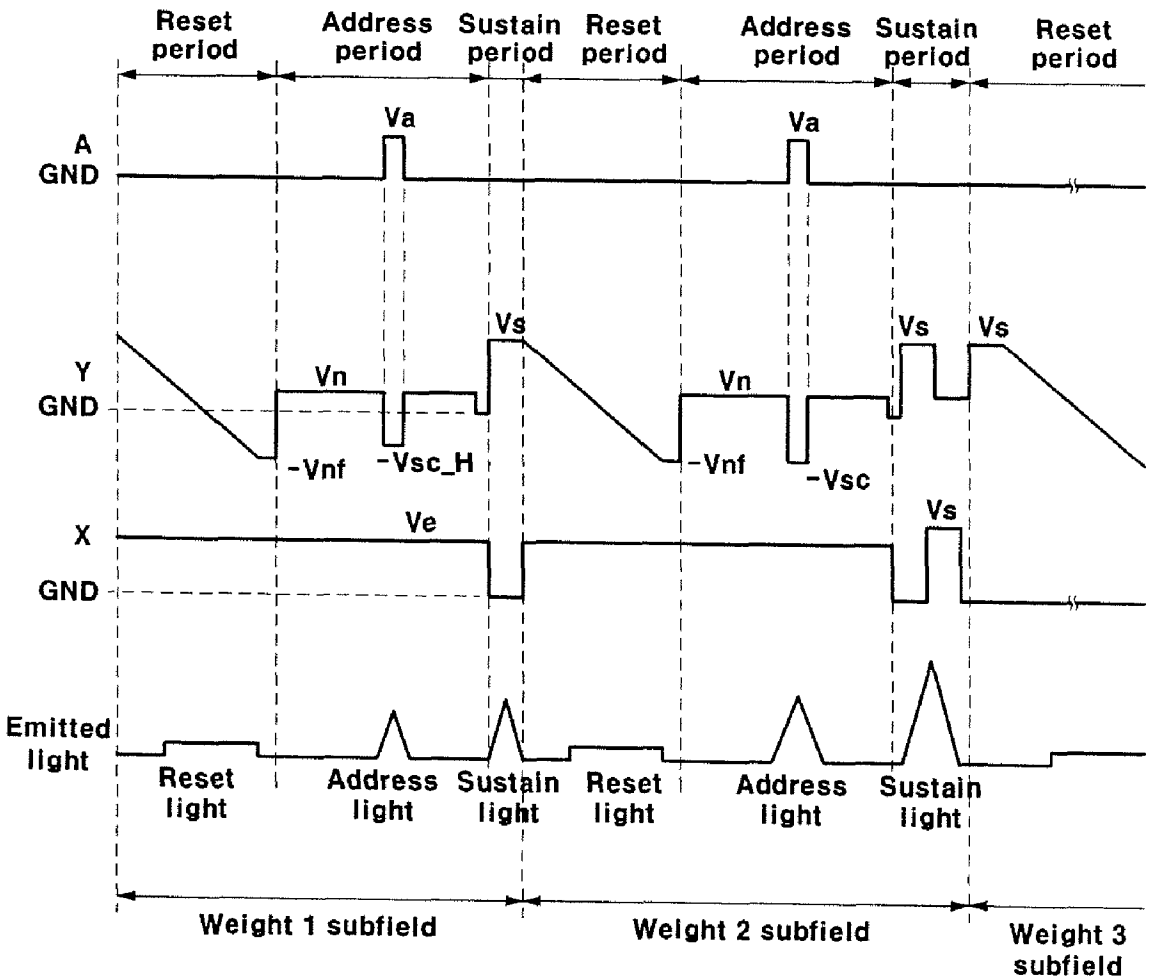
FIG. 10 shows a diagram for representing plasma display panel driving waveforms and emitted light from each subfield according to a sixth exemplary embodiment of the present invention.

FIG. 10 shows a diagram for representing plasma display panel driving waveforms and emitted light from each subfield according to the sixth exemplary embodiment of the present invention. As shown, the erase period is eliminated in a manner similar to the manner shown in FIG. 9. In the reset period of a subfield after a subfield with a weight of 1, the voltage of scan electrode Y is reduced to the voltage of −Vnf while the voltage of Vs is applied to scan electrode Y in the subfield prior to the reset period (i.e., in the subfield with the weight of 1). In this embodiment, (−) wall charges and (+) wall charges respectively formed on scan electrode Y and sustain electrode X by the ramp falling waveform are eliminated while (−) wall charges and (+) wall charges are formed on the scan electrode Y and the sustain electrode X by the voltage of Vs applied to scan electrode Y and a reference voltage 0V applied to sustain electrode X in the sustain period of the subfield with the weight of 1.

The diagram for representing each emitted light is also shown in FIG. 5 and in FIG. 10. However, the invention is not thereby limited because these figures may be different from a practical figure because the diagram is described for the purpose of representing the generation of emission. In addition, the weight of a subfield can be described as the weight of 1 in order to represent a minimum weight, however, the weight can represent 0.5 or 0.25 if 0.5 or 0.25 is a minimum weight. Moreover, the waveform in the reset period of the subfield with the weight of 1 according to the first exemplary embodiment of the present invention can also be applied to the second and sixth exemplary embodiments of the present invention, (i.e., −Vnf_L can be applied to scan electrode Y in a reset period).

Also, the exemplary embodiment of the present invention may be applied to the subfields having a low weight second to the subfield having the lowest weight. That is, a plurality of the subfields may be divided into a group to which the exemplary embodiment is applied and a group to which the exemplary embodiment is not applied.

In view of the foregoing, systems and methods of the present invention provide more effective driving waveforms to maximize the representation performance of low gray scales as compared to conventional driving waveforms.

While this invention has been described in connection with certain exemplary embodiments, it is to be understood that the invention is not limited to the disclosed embodiments, but, on the contrary, is intended to cover various modifications included within the spirit and scope of the appended claims, and equivalents thereof.

What is claimed is:

1. A method of driving a plasma display panel including scan electrodes and address electrodes to display an image in a frame including a first subfield having a first weight and a second subfield having a second weight higher than the first weight of the first subfield, each of the first subfield and the second subfield each including an address period, the method comprising, in the address period of the first subfield:

applying a first scan voltage and a first address voltage to at least one scan electrode of the scan electrodes and at least one address electrode of the address electrodes, respectively; and floating the at least one scan electrode of the scan electrodes after applying the first scan voltage to the at least one scan electrode of the scan electrodes.

2. The method of claim 1, further comprising:

in the address period of the first subfield, applying a voltage higher than the first scan voltage to the at least one scan electrode of the scan electrodes after floating the at least one scan electrode of the scan electrodes.

3. The method of claim 1, further comprising:

in the address period of the second subfield, applying a second scan voltage and a second address voltage to at least one scan electrode of the scan electrodes and at least one address electrode of the address electrodes, respectively.

4. The method of claim 3, wherein, in the address period of the second subfield, the at least one scan electrode of the scan electrodes is not floated after the second scan voltage is applied to the at least one scan electrode of the scan electrodes.

5. The method of claim 3, wherein the first scan voltage is substantially the same as the second scan voltage.

6. The method of claim 3, wherein the first scan voltage is higher than the second scan voltage.

7. The method of claim 1, wherein each of the first subfield and the second subfield further including a reset period, wherein the method further comprises:

gradually reducing a voltage at the scan electrodes from a first voltage to a final voltage, in the reset period of the first subfield; and gradually reducing the voltage at the scan electrodes from a second voltage to the final voltage, in the reset period of the second subfield.

8. The method of claim 1, wherein each of the first subfield and the second subfield further including a reset period, wherein the method further comprises:

gradually reducing a voltage at the scan electrodes from a first voltage to a first final voltage, in the reset period of the first subfield; and gradually reducing the voltage at the scan electrodes from a second voltage to a second final voltage higher than the first final voltage, in the reset period of the second subfield.

9. A method of driving a plasma display panel including scan electrodes and address electrodes to display an image in a frame including a first subfield having a first weight and a second subfield having a second weight higher than the first weight of the first subfield, each of the first subfield and the second subfield including an address period and a reset period, the method comprising, gradually reducing a voltage at the scan electrodes from a first voltage to a final voltage, in the reset period in the first subfield;

applying a first scan voltage and a first address voltage to at least one scan electrode of the scan electrodes and at least one address electrode of the address electrodes, respectively, in the address period of the first subfield;

gradually reducing the voltage at the scan electrodes from a second voltage to a second final voltage, in the reset period of the second subfield; and applying a second scan voltage and a second address voltage to the at least one scan electrode of the scan electrodes and the at least one address electrode of the address electrodes, respectively, in the address period of the second subfield, wherein a difference between the first final voltage and the first scan voltage is greater than a difference between the second final voltage and the second scan voltage.

10. The method of claim 9, wherein the first scan voltage is higher than the second scan voltage.

11. The method of claim 9, wherein the first final voltage is lower than the second final voltage.

12. A plasma display device to display an image in a frame divided into a plurality subfields including a first subfield having a first weight and a second subfield having a second weight higher than the first weight of the first subfield, the plasma display device comprising:

a plurality of scan electrodes; and a driver adapted to:

sequentially apply a first scan voltage to the scan electrodes in an address period of the first subfield, float the scan electrodes after the scan electrodes received the first scan voltage for a time period in the address period of the first subfield, and sequentially apply a second scan voltage to the scan electrodes in an address period of the second subfield.

13. The plasma display device of claim 12, wherein the driver is further adapted to sequentially apply a voltage higher than the first scan voltage to the scan electrodes after floating the scan electrodes.

14. The plasma display device of claim 12, wherein the first scan voltage is substantially the same as the second scan voltage.

15. The plasma display device of claim 12, wherein the first scan voltage is higher than the second scan voltage.

16. The plasma display device of claim 12, wherein the driver is further adapted not to float the scan electrodes after the scan electrode electrodes received the second scan voltage in the address period of the second subfield.

17. The plasma display device of claim 12, wherein the driver is further adapted to gradually reduce a voltage at the scan electrodes from a first voltage to a final voltage in a reset period of the first subfield, and gradually reduce the voltage at the scan electrodes from a second voltage to the final voltage in a reset period of the second subfield.

18. The plasma display device of claim 12, wherein the driver is further adapted to gradually reduce a voltage at the scan electrodes from a first voltage to a first final voltage in a reset period of the first subfield, and gradually reduce the voltage at the scan electrodes from a second voltage to a second final voltage higher than the first final voltage in a reset period of the second subfield.

19. A plasma display device to display an image in a frame being divided into a plurality subfields including a first subfield having a first weight and a second subfield having a second weight higher than the first weight of the first subfield, the plasma display device comprising:

a plurality of scan electrodes; and a driver adapted to:

gradually reduce a voltage at the scan electrodes from a first voltage to a final voltage in a reset period of the first subfield, sequentially apply a first scan voltage to the scan electrodes in an address period of the first subfield, gradually reduce the voltage at the scan electrodes from a second voltage to a second final voltage in a reset period of the second subfield, and sequentially apply a second scan voltage to the scan electrodes in an address period of the second subfield, wherein a difference between the first final voltage and the first scan voltage is greater than a difference between the second final voltage and the second scan voltage.

20. The plasma display device of claim 19, wherein the first scan voltage is higher than the second scan voltage.

21. The plasma display device of claim 19, wherein the first final voltage is lower than the second final voltage.

* * * * *

UNITED STATES PATENT AND TRADEMARK OFFICE

CERTIFICATE OF CORRECTION

PATENT NO. : 7,936,320 B2
APPLICATION NO. : 11/966949
DATED : May 3, 2011
INVENTOR(S) : Woo-Joon Chung et al.

It is certified that error appears in the above-identified patent and that said Letters Patent is hereby corrected as shown below:

In the Claims

| | |
|---|---|
| Column 11, Claim 12, line 57. | After "plurality"<br>Insert -- of -- |
| Column 12, Claim 16, line 21. | Delete "scan electrode electrodes"<br>Insert -- scan electrodes -- |
| Column 12, Claim 19, line 37. | After "plurality"<br>Insert -- of -- |

Signed and Sealed this
Third Day of April, 2012

David J. Kappos

David J. Kappos
*Director of the United States Patent and Trademark Office*